US006546561B2

(12) United States Patent
Duhamell

(10) Patent No.: US 6,546,561 B2
(45) Date of Patent: Apr. 15, 2003

(54) INFLATABLE SAFETY VEST

(76) Inventor: John Duhamell, 333 E. Stuart Ave., Ste. F, Redlands, CA (US) 92374-4440

( * ) Notice: Subject to any disclaimer, the term of this patent is extended or adjusted under 35 U.S.C. 154(b) by 0 days.

(21) Appl. No.: 10/043,917

(22) Filed: Jan. 11, 2002

(65) Prior Publication Data

US 2002/0092088 A1 Jul. 18, 2002

Related U.S. Application Data

(60) Provisional application No. 60/261,480, filed on Jan. 12, 2001.

(51) Int. Cl.[7] ..... A41D 1/04

(52) U.S. Cl. ..... 2/102; 2/DIG. 3; 2/462

(58) Field of Search ..... 2/102, 455, 456, 2/463, 464, 465, 467, 411, 413, DIG. 3, 462; 441/88, 90, 92, 94, 96

(56) References Cited

U.S. PATENT DOCUMENTS

| | | | | | |
|---|---|---|---|---|---|
| 3,930,667 | A | * | 1/1976 | Osuchowski et al. | 2/DIG. 3 |
| 4,059,852 | A | * | 11/1977 | Crane | 2/456 |
| 4,637,074 | A | * | 1/1987 | Taheri | 2/456 |
| 4,685,151 | A | * | 8/1987 | Kincheloe | 2/16 |
| 4,825,469 | A | * | 5/1989 | Kincheloe | 2/16 |
| 5,746,442 | A | * | 5/1998 | Hoyaukin | 2/456 |
| 5,781,936 | A | * | 7/1998 | Alaloof | 2/456 |
| 5,867,842 | A | * | 2/1999 | Pinsley et al. | 2/462 |
| 6,125,478 | A | * | 10/2000 | Alaloof | 2/456 |
| 6,230,333 | B1 | * | 5/2001 | Umeda | 2/463 |
| 6,350,168 | B1 | * | 2/2002 | Kroll et al. | 2/108 |

FOREIGN PATENT DOCUMENTS

| | | | |
|---|---|---|---|
| DE | 197 50 898 A1 | 4/1999 | A41D/13/00 |

* cited by examiner

*Primary Examiner*—Gary L Welch
(74) *Attorney, Agent, or Firm*—Klein, O'Neill & Singh, LLP

(57) ABSTRACT

A body protection device in the form of an inflatable vest includes an inflation mechanism that is actuated in response to the separation or removal of the wearer from a vehicle such as a motorcycle, ski-mobile, or personal water craft. Attached to the outside of the vest is a compressed gas cartridge communicating with the interior of the vest through a cartridge actuation mechanism and an inflation tube. The cartridge actuation mechanism includes a triggering device that can be actuated to open the cartridge by means of an actuation lever. The actuation lever actuates the triggering device in response to a pulling force of predetermined magnitude, and in doing so detaches from the actuation mechanism. The actuation lever is connected to the vehicle by a lanyard. When a wearer of the vest is forcibly separated from the vehicle, the lanyard exerts an actuation force on the actuation lever, which actuates the triggering device before detaching from the actuation mechanism, thereby opening the cartridge and allowing gas from the cartridge to inflate the vest. The vest is advantageously provided with a deflation tube and a deflation valve.

2 Claims, 3 Drawing Sheets

INFLATABLE SAFETY VEST

CROSS-REFERENCE TO RELATED APPLICATION

This application claims priority, under 35 U.S.C. §119(e), from U.S. Provisional Application No. 60/261,480; filed Jan. 12, 2001.

FEDERALLY-FUNDED RESEARCH OR DEVELOPMENT

Not Applicable

BACKGROUND OF THE INVENTION

The present invention relates to the field of body protection devices, and more particularly to items of apparel that are inflatable so as to offer protection to a part of the wearer's body.

Inflatable items for the protection of a part of the human body are well known. For example, items such as protective pads and helmets have been made with inflatable bladders to offer protection to a body part from blows, falls, and other sources of trauma. Also known are inflatable vests used as life preservers, i.e., to provide added buoyancy to keep the human body afloat in water.

Inflatable life vests of conventional design typically include a unitary internal bladder that is connected to a source of pressurized gas, typically a $CO_2$ cartridge. The cartridge must be actuated manually, by pulling an actuation cord connected to a valve-actuation pin that opens a valve connecting the cartridge to a gas inlet tube communicating with the bladder.

In certain situations, it may be desirable to protect a person from a sudden trauma that may occur while the person is engaging in a hazardous or semi-hazardous activity. There may not be sufficient time or an appropriate opportunity manually to actuate the inflation mechanism of an inflatable protective garment (such as a vest) before the blow or fall is suffered. An example of such an activity is riding a motorcycle, ski-mobile, or personal water craft. While in some cases (particularly in riding a personal water craft), it may be acceptable or even desirable to wear a pre-inflated vest, in the case of motorcycle riding, it is not practical to do so. Consequently, motorcycle riders typically wear bulky jackets made of leather or other heavy material to offer protection in a fall. These bulky garments, however, are often uncomfortable, particularly in hot weather.

There has accordingly been a long-felt need for an inflatable protective garment that can be worn comfortably in a deflated condition, and yet that can be automatically and nearly instantaneously inflated upon the onset of a potentially trauma-inducing incident.

SUMMARY OF THE INVENTION

Broadly, the present invention is a body protection device in the form of an inflatable garment having an inflation mechanism that is actuated in response to the separation or removal of the wearer from a motor vehicle, in particular, a motorcycle, ski-mobile, or personal water craft. In a specific preferred embodiment, the invention is embodied as an inflatable vest, comprising an inflatable bladder configured as a vest, a compressed gas cartridge communicating with the interior of the bladder through an inflation tube, and a cartridge actuation mechanism comprising a triggering device that can be actuated to open the cartridge. The triggering device includes an actuation lever that actuates the triggering device, and in doing so detaches from the actuation mechanism, upon being pulled with a force of predetermined magnitude. The invention further comprises a lanyard having a first end connected to the actuation lever and a second end that is attachable to the vehicle. When the wearer is thrown or forcibly separated from the vehicle, the lanyard exerts an actuation force on the actuation lever, which actuates the triggering device before detaching from the actuation mechanism, thereby opening the cartridge and allowing the gas from the cartridge to inflate the bladder.

DETAILED DESCRIPTION OF THE PREFERRED EMBODIMENT

Figure 1:
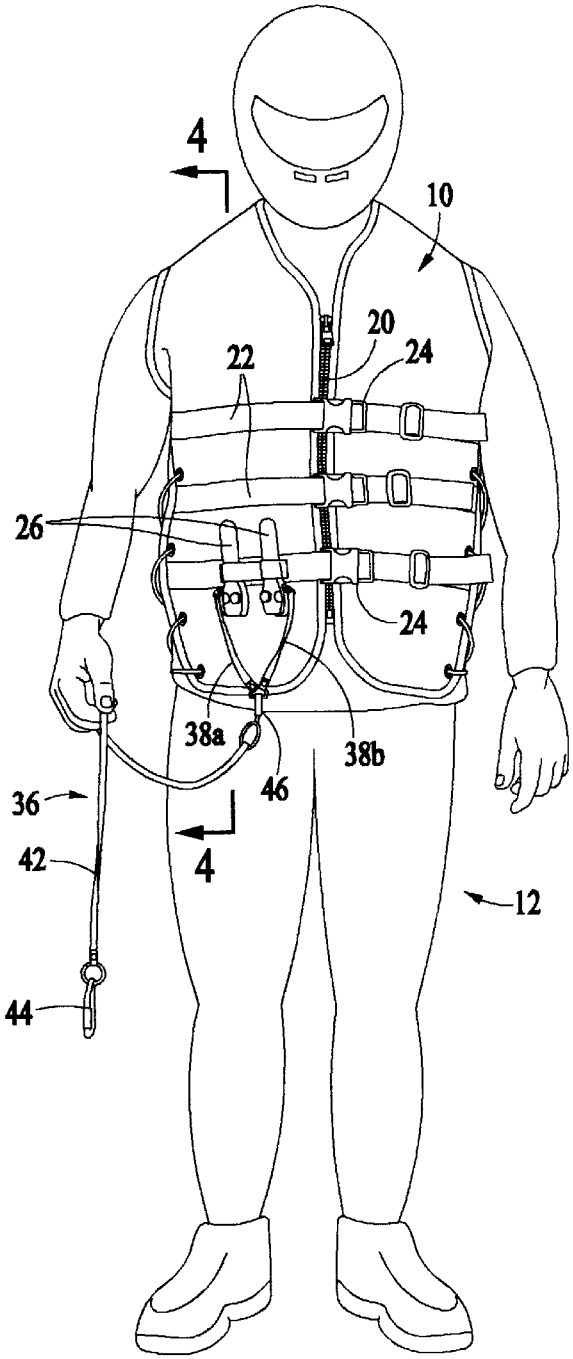
FIG. 1 is a front elevational view of a person wearing an inflatable safety vest in accordance with a preferred embodiment of the present invention, the vest being in its deflated state.
Figure 2:
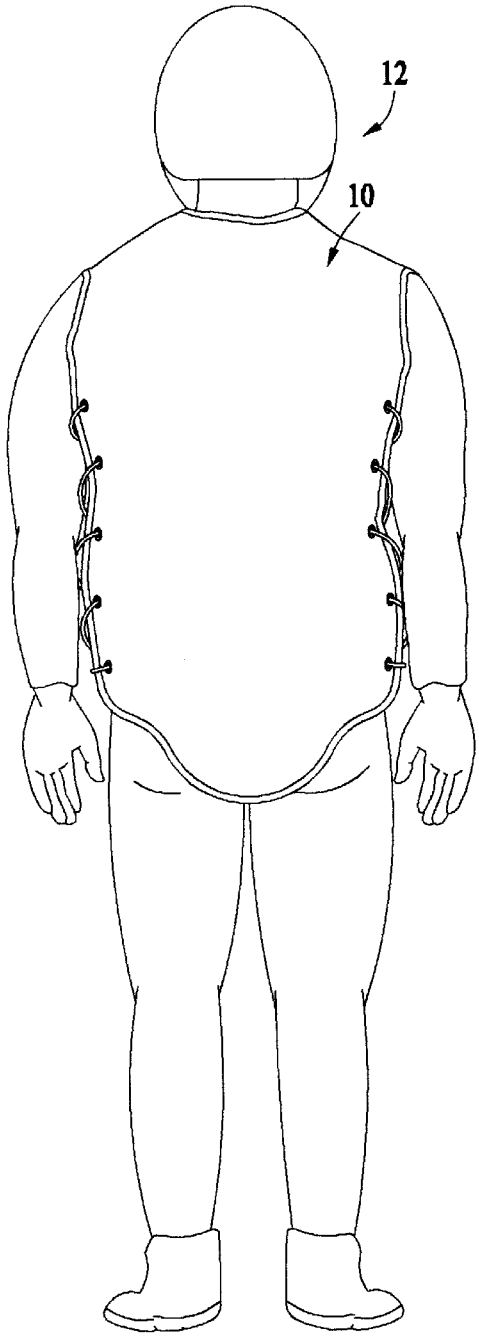
FIG. 2 is a rear elevational view of the person and vest of FIG. 1.
Figure 3:
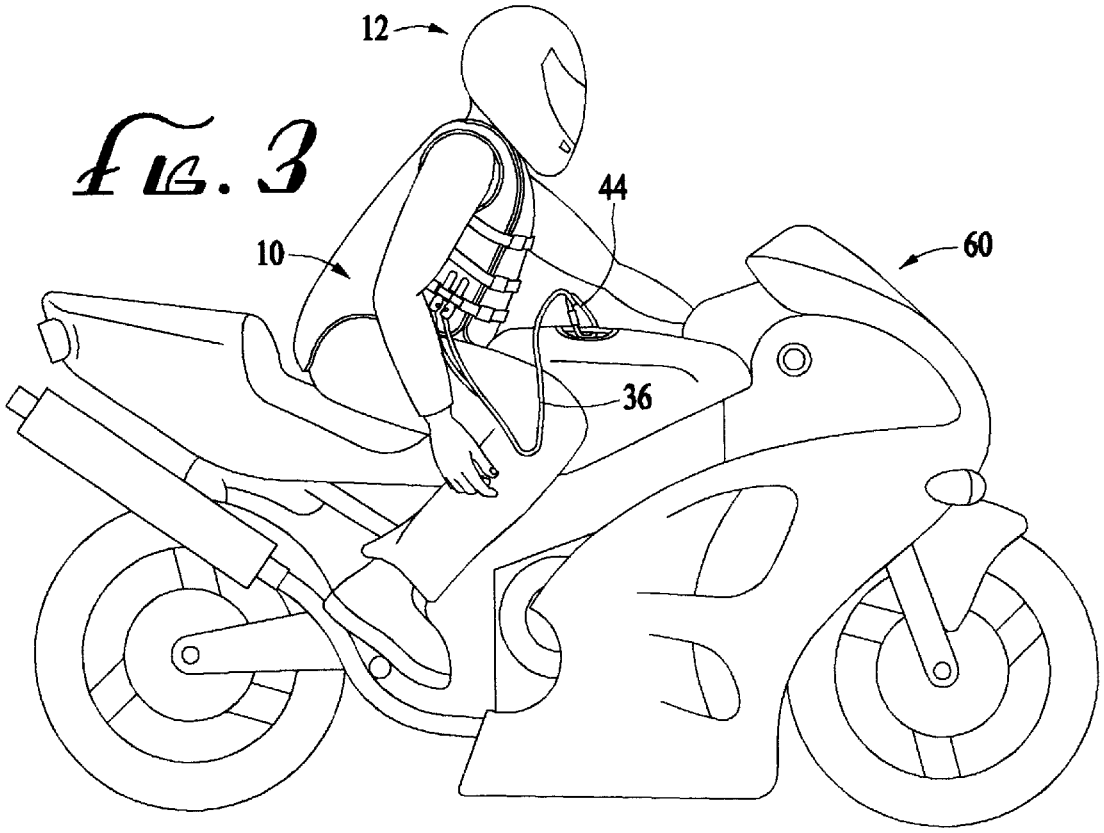
FIG. 3 is a side elevational view of a person wearing the vest of FIG. 1 while riding a motorcycle, the vest being in its deflated state.
Figure 4:
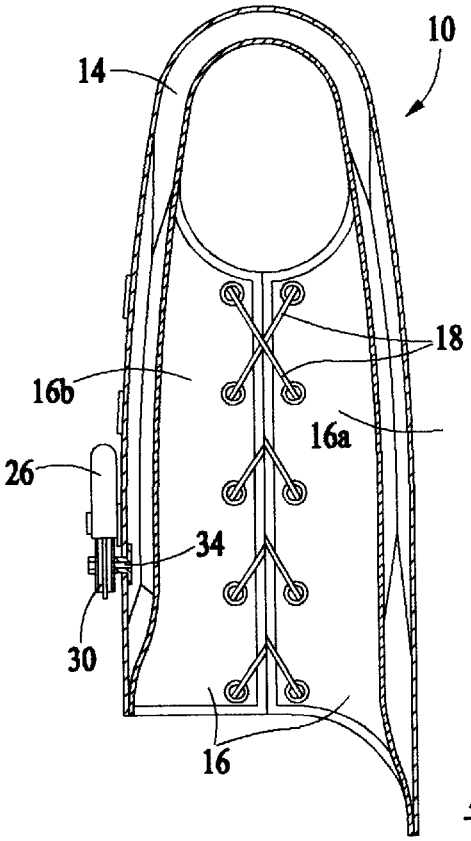
FIG. 4 is a cross-sectional view of the vest of FIG. 1, taken along line 4—4 of FIG. 1, but omitting the person wearing the vest.

FIGS. 1, 2, and 3 show an inflatable safety vest 10, in accordance with a preferred embodiment of the present invention, being worn by a person 12 wearing the other apparel typically worn by a motorcycle rider. In these Figures, the vest 10 is shown in its deflated state. The vest 10, as best shown in FIG. 4, comprises an inflatable, gas-tight bladder 14 configured to form a unitary back portion, left and right shoulder portions, and left and right chest portions of the vest. The vest 10 also includes side panels 16 connecting the chest and back portions. The side panels 16 may be unitary, or, as shown in FIG. 4, they may each be divided into front and rear portions 16*aa,* 16*ab,* respectively, connected to each other by means such as laces 18. The left and right chest portions of the vest 10 are attachable to each other by fastening means such as a zipper 20, although other means, such as snaps, buttons, hook-and-loop fasteners, and buckles may also be used. Size adjustment means may be provided to assure a snug and secure fit of the vest 10 on persons of different sizes. For example, one or more cross-straps 22, that are length-adjustable by means of buckles 24, may be attached to the outside of the vest 10.

As shown in FIGS. 1, 4, 6, and 7, the vest 10 is provided with a source of compressed gas for inflating the vest. In the preferred embodiment, the compressed gas source is at least one compressed $CO_2$ gas cartridge 26, and preferably two such cartridges 26, as shown. Each cartridge 26 is removably secured within a fabric loop 28 fastened to one of the straps 22. The gas cartridges 26 are of conventional design, and are commercially available from a number of sources. While such cartridges come in a variety of sizes, two cartridges, each of the 16 gram net contents weight size, provide good results.

Figure 7:
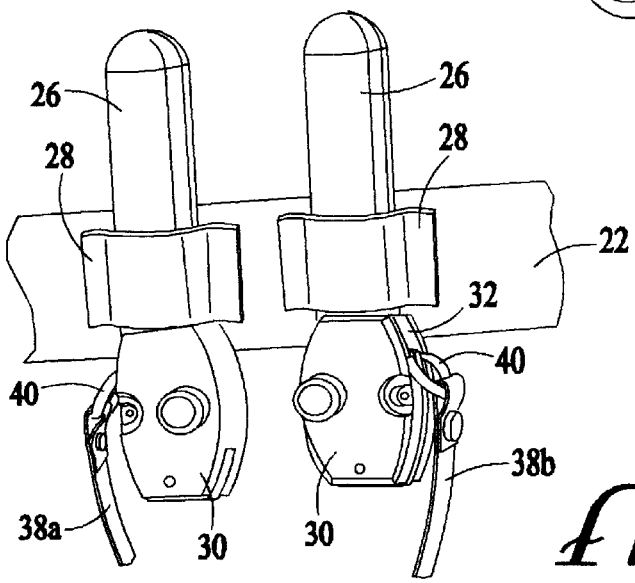
FIG. 7 is a detailed view of the compressed gas cartridges and the actuation mechanism used in the present invention.

As shown in FIG. 7, each cartridge 26 is removable coupled (as by a threaded fitting, not shown) to a cartridge actuation mechanism 30. The actuation mechanism 30 is of conventional design, and is commercially available from a number of sources. For example, if 16 gram cartridges are used, the actuation mechanism 30 may be the Model 840AM, manufactured by Halkey-Roberts, of St. Petersburg, Fla., or the equivalent. The actuation mechanism 30 includes a triggering device that comprises an actuation lever 32 that is detachably connected to a spring-loaded pin or rod (not shown), installed in the actuation mechanism 30 so as to rupture the neck of the cartridge 26 when the lever is pulled with a force of predetermined magnitude, thereby opening or "firing" the cartridge 26.

The vest is provided with a pair of inflation tubes 34 (only one of which is shown in FIG. 4). Each inflation tube 34 has a first end on the exterior of the vest that is connected to one of the cartridges 26 through its associated actuation mechanism 30, and a second end opening into the interior of the bladder 14. When a cartridge 26 is opened, as described above, gas from the open cartridge 26 passes through its associated inflation tube 34 into the interior of the bladder 14 to inflate the vest. When the lever 32 is pulled with a force sufficient to actuate the actuation mechanism 30, the lever 32 detaches from the mechanism 30.

The invention further comprises a lanyard 36 having a Y-shaped or bifurcated proximal portion comprising two branches 38*aa,* 38*ab,* each of which is secured to one of the actuation levers 32 by an attachment ring 40. If only one cartridge 26 is used, the proximal portion of the lanyard 36 will be unitary, rather than bifurcated. The lanyard 36 has a main portion 42 with a distal end that is terminated by a clip 44. The main portion 42 is advantageously connected to the proximal portion by a snap fitting 46 that permits the main portion 42 to be detached from the proximal portion.

Figure 5:
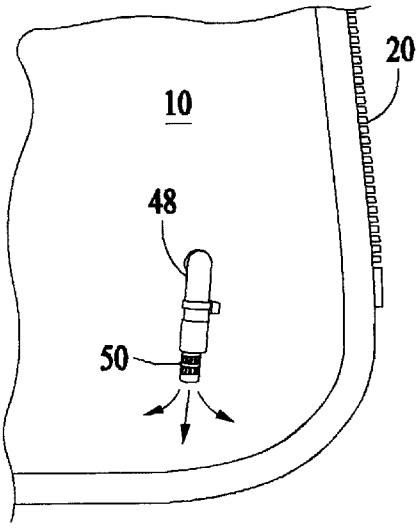
FIG. 5 is a detailed view of a portion of the inwardly-facing surface of the vest, showing a deflation tube that is advantageously included with the vest.

FIG. 5 shows a bladder deflation tube 48 that is advantageously provided on the inner surface of the vest, preferably on the lower part of one of the chest portions. The deflation tube 48 communicates between the interior of the bladder 14 and the ambient atmosphere through a deflation valve 50, of conventional design, that can be manually opened to deflate the vest 10 after it has been inflated. The valve 50 may, for example, be of the well-known type that is rotated in opposite directions to move it respectively toward and away from a valve seat to close and open the valve, respectively.

In operation, as shown in FIG. 3, a person 12 wears the vest 10 while riding on a vehicle, such as a motorcycle 60. The vest 10 is normally in its deflated state. The proximal lanyard branches 38*aa,* 38*b* are respectively secured to the levers 32 of the triggering devices in the two actuation mechanisms 30. The levers 32, in turn, are attached to their respective actuation mechanisms 30. The distal end clip 44 of the lanyard 36 is clipped to a convenient portion or component of the vehicle 60.

Figure 6:
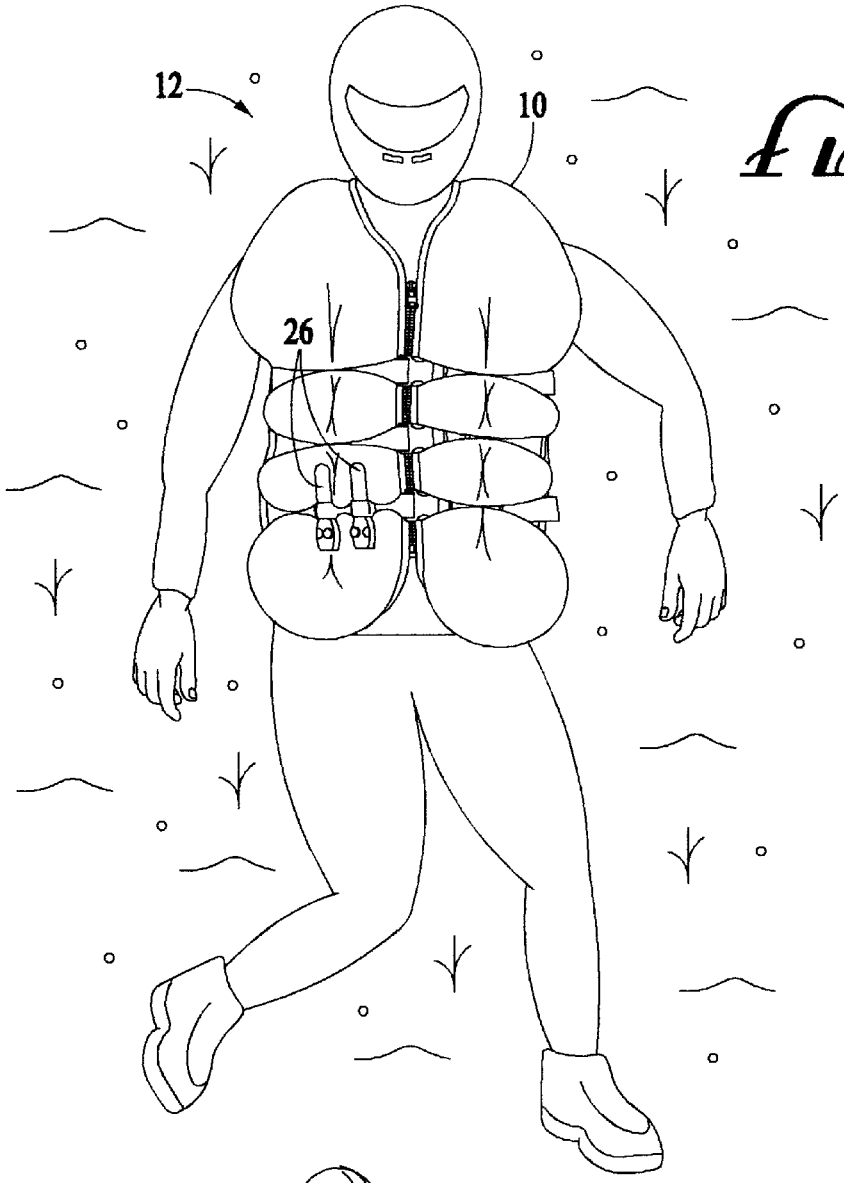
FIG. 6 is a front elevational view of the person lying on the ground with the vest in its inflated state.

Should the person 12 be thrown from or fall off of the vehicle 60, the resulting force applied to the lanyard 36 is transmitted to the actuation levers 32, resulting in the actuation of the triggering devices in the actuation mechanisms 30, thereby firing the cartridges 26 to inflate the bladder 14 through the inflation tubes 34. At the same time, the actuation force applied to the lanyard 36 is sufficient to separate the actuation levers 32 from the actuation mechanisms 30. Consequently, as shown in FIG. 6, the vest 10 is inflated before the person 12 hits the ground, while the vest itself is separated from the lanyard 36. The impact of the fall is softened by the inflated vest 10, thereby reducing the likelihood of severe injuries. After impact, the vest 10 can be deflated for reuse by opening the deflation valve 50.

What is claimed is:

1. A body protection device for a person riding a vehicle, comprising:

an inflatable vest having an exterior and an airtight interior;

a compressed gas cartridge attached to the exterior of the vest;

a cartridge actuation mechanism operably connected to the cartridge and comprising:

a triggering device that is operable to open the cartridge; and an actuation lever operatively connected to the triggering device so as to actuate the triggering device in response to a pulling force of a predetermined magnitude, wherein the actuation lever is detachable from the actuation mechanism in response to the pulling force of predetermined magnitude;

an inflation tube having a first end connected to the gas cartridge through the actuation mechanism and a second end opening into the interior of the vest, whereby gas can flow from the cartridge into the interior of the vest through the inflation tube when the cartridge is opened by the triggering device;

a lanyard having a first end connected to the actuation lever and a second end that is attachable to the vehicle, whereby the application of the pulling force of predetermined magnitude to the lanyard actuates the triggering device and separates the actuation lever from the actuation mechanism;

a deflation tube communicating between the interior of the vest and the ambient atmosphere;

a deflation valve in the deflation tube, the valve being rotatably operable between a closed position and an open position through which the vest may be deflated through the deflation tube;

a length-adjustable cross-strap attached to the outside of the vest for adjusting the fit of the vest on a person;

a buckle on the cross-strap that is operable to adjust the length of the cross-strap; and means on the cross-strap for removably holding the gas cartridge.

2. The device of claim 1, wherein the means for holding the gas cartridge includes a fabric loop attached to the cross-strap.

* * * * *